US006414419B1

(12) United States Patent
Kim

(10) Patent No.: US 6,414,419 B1
(45) Date of Patent: Jul. 2, 2002

(54) IGNITION SPARK PLUG

(76) Inventor: Sei Y. Kim, 6F Daihyun Rd., 861-9 Anyang, 2Dong Anyang city, Kyunggi-Do (KR)

( * ) Notice: Subject to any disclaimer, the term of this patent is extended or adjusted under 35 U.S.C. 154(b) by 0 days.

(21) Appl. No.: 09/474,812

(22) Filed: Dec. 29, 1999

(51) Int. Cl.[7] ..... H01T 13/20
(52) U.S. Cl. ..... 313/141; 313/139
(58) Field of Search ..... 313/123, 124, 313/132, 139, 141

(56) References Cited

U.S. PATENT DOCUMENTS 1,225,467 A * 5/1917 Miller ..... 313/139
2,942,135 A * 6/1960 McLaren ..... 313/139
3,009,075 A * 11/1961 Hensley ..... 313/141
3,239,710 A 3/1966 Toporzysek
3,313,972 A 4/1967 Beesch
4,023,058 A 5/1977 Lara et al.

* cited by examiner

*Primary Examiner*—Vip Patel
(74) *Attorney, Agent, or Firm*—Birch, Stewart, Kolasch & Birch, LLP

(57) ABSTRACT

An ignition spark plug which comprises an insulator containing a center bore, a center electrode extending through the center bore in an insulator; a circular plate-type center electrode attached to and extending from one end of said center electrode, said circular plate-type center electrode including:

a plurality of grooves provided at the periphery of the circulate plate-type electrode defining a tooth wheel for expanding the size of the spark in an ignition chamber; and a ring electrode disposed at an end of a threaded metal shell extending from a metal housing and spaced apart from said circular plate-type center electrode, whereby the improved ignition spark plug provides an excellent starting ability of the engine, completes the combustion of the fuel in the ignition chamber, and prevents the exhaust gas from fuming out.

4 Claims, 1 Drawing Sheet

IGNITION SPARK PLUG

BACKGROUND OF THE INVENTION

1. Field of the Invention

The present invention relates to an improved ignition spark plug and more particularly to a spark plug for use in an internal combustion engine which includes a circular plate-type center electrode which faces an outer electrode in opposing relationship for providing a spark, whereby the combustion ignited by the spark plug of a larger size is completed faster than normal combustion ignited by a smaller diameter or area of spark.

2. Description of Related Art

Various types of ignition spark plugs are known in the art. Generally, as shown in FIG. 1, a conventional ignition spark plug includes a main body portion having a threaded cylinder engaging end 117 with an L-shaped metal pin or overhanging electrode 111 and a tapering portion 116 extending from the main body portion and a contact or center electrode 112 disposed at its inner end and spaced inwardly from the overhanging electrode 111.

However, such a conventional ignition spark plug suffers from a number of problems. For example, since combustion of the conventional ignition spark is ignited by a small diameter or area of spark, the combustion is not fully completed and sufficiently fast, and accordingly the conventional ignition spark plug cannot increase engine power in a flame discharging spark.

Also, since such a conventional ignition spark plug cannot expect complete combustion, the conventional ignition spark plug cannot improve the starting ability of the engine and cannot prevent exhaust gas from fuming out.

SUMMARY OF THE INVENTION

Accordingly, it is an object of the present invention to provide an improved ignition spark plug which eliminates the above problems encountered with conventional ignition spark plugs.

Another object of the present invention is to provide an ignition spark plug which includes an outer electrode and a circular plate-type center electrode extending from the center electrode within a center bore for facing an outer electrode in an opposing relationship for providing a spark, whereby the combustion ignited by a spark of larger size is completed faster when compared with that of a conventional ignition spark plug.

Still another object of the present invention is to provide an ignition spark plug which is simple in structure, inexpensive to manufacture, durable in use, and refined in appearance.

Other objects and further scope of applicability of the present invention will become apparent from the detailed description given hereinafter. It should be understood, however, that the detailed description and specific examples, while indicating preferred embodiments of the invention are given by way of illustration only, since various changes and modifications within the spirit and scope of the invention will become apparent to those skilled in the art from this detailed description.

Briefly described, the present invention is directed to an ignition spark plug which includes an outer electrode and a circular plate-type center electrode extending a short distance from a center electrode within a center bore, wherein the circular plate-type center electrode has at least one groove and a plurality of teeth disposed at the periphery of the circular center electrode for improving the combustion of an engine and preventing exhaust gas from fuming out.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 2:
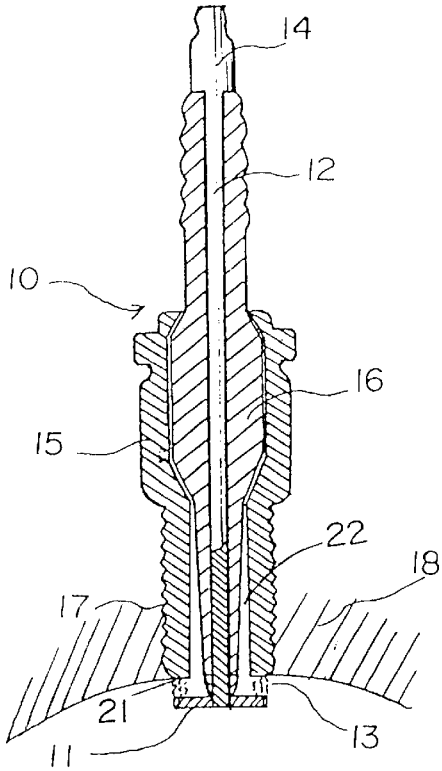
FIG. 2 is a partially sectioned side view of one possible embodiment of an ignition spark plug according to the present invention.
Figure 3:
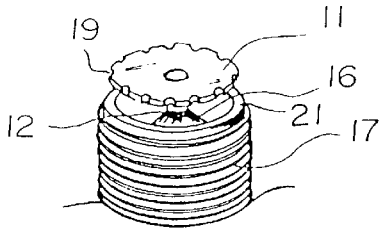
FIG. 3 is a perspective view of a circular plate-type center electrode of the ignition spark plug of FIG. 2.
Figure 4:
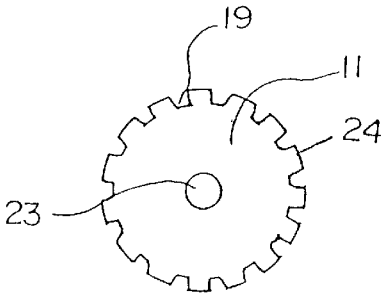
FIG. 4 is a top plan view of a circular plate-type center electrode of the ignition park plug of FIG. 2.

Referring now in detail to the drawings for the purpose of illustrating preferred embodiments of the present invention, the ignition spark plug 10 for use in an internal combustion engine as shown in FIGS. 2, 3, and 4 includes a center electrode 14 extending through a center bore 12 in an insulator 16 mounted in a central passage 22 through a threaded metal shell 17, and a circular plate-type electrode 11 crossly attached to the center electrode 14 within the center bore 12. The threaded metal shell 17 extends from a metal housing 15 and has a ring electrode or outer electrode 21 disposed at an end portion thereof.

As shown in FIG. 2, the ring electrode 21, which extends from the threaded metal shell 17 is spaced from the circular plate-type center electrode 11 for forming a spark gap or an arc 13. Thus, the surface of the circular plate-type center electrode 11 becomes the spark-discharging portion and the surface of the ring electrode 21 becomes the spark-landing portion. The surfaces of the spark-discharging and spark-landing portions are disposed in opposing relation with respect to each other.

Referring to FIGS. 3 and 4, the circular plate-type center electrode 11 has an aperture for firmly receiving one end of the center electrode 14 within the center bore 12 and a plurality of grooves 19 which define teeth 24 disposed at the periphery of the circular plate to produce a toothed wheel. The discharging surface of the circulate plate-type center electrode 11 is surrounded by the landing surface of the ring electrode 21. Therefore, fuel on the opposite side of the ring electrode 21 is ignited substantially simultaneously with the ignition of fuel by the spark between the ring electrode 21 and the center electrode 11.

The plurality of teeth 24 define a plurality of spark-discharging ports in the form of a closed and shaped geometric figure for accelerating a spark between the center electrode 11 and ring electrode 21. When the geometric figures are in the form of teeth 24, the spark-discharging portion and the spark-landing portion are annular, so that combustion in an ignition chamber 18 is completed for improving the starting ability of an engine and preventing exhaust gas from fuming out.

Figure 6:
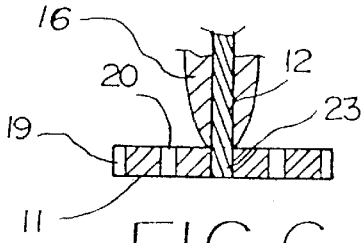
FIG. 6 is a sectional side view of the circular plate-type center electrode of FIG. 5.
Figure 5:
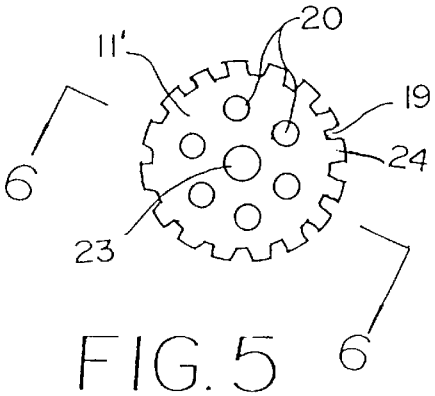
FIG. 5 is a top plan view of a second embodiment of the circular plate-type center electrode of the ignition spark plug according to the present invention.

Referring in detail to FIGS. 5 and 6, there are illustrated a second embodiment of the circular plate-type center electrode 11' which includes a plurality of openings 20 and a plurality of grooves 19 and teeth 24 for expanding the spark-discharging port so as to accelerate the spark in the ignition chamber 18.

Figure 7:
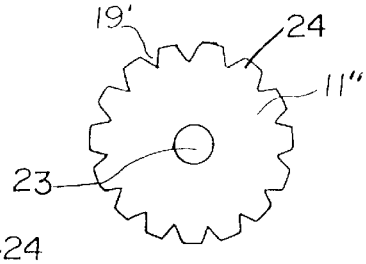
FIG. 7 is a top plan view of a third embodiment of the circular plate-type center electrode of the ignition spark plug according to the present invention.

As shown in FIG. 7, there is illustrated a third embodiment of the circular plate-type center electrode 11" which includes a plurality of V-shaped grooves 19' and a plurality of teeth 24 for expanding the spark-discharging port so as to accelerate the spark in the ignition chamber 18. In this case, the plurality of openings 20 can be disposed on the circular plate-type center electrode 11".

Figure 8:
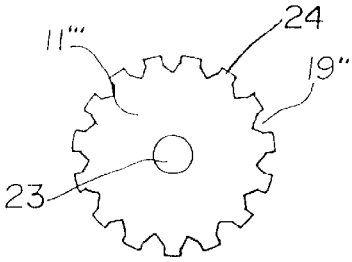
FIG. 8 is a top plan view of a fourth embodiment of the circular plate-type center electrode of the ignition spark plug according to the present invention.

Referring in detail to FIG. 8, there is illustrated a fourth embodiment of the circular plate-type center electrode 11'" which comprises a plurality of grooves 19" having a U-shaped outer portion which terminates into a V-shaped inner portion, said slots being defined by a plurality of teeth for expanding the spark-discharging port which accelerates the spark in the ignition chamber 18. In this case, the plurality of openings 20 are disposed on the circular plate-type center electrode 11'".

In the illustrated structure, the insulator 16 is sealed within the metal housing 15 in a conventional manner. The center electrode 14 has an upper end portion which is adapted to receive a suitable plug wire (not shown) in any conventional manner.

As shown in FIGS. 2 and 3, the ignition spark plug 10 for use in an internal combustion engine according to the present invention operates as follows. As described in detail hereinafter, the ring electrode or outer electrode 21 closely faces the circular plate-type center electrode 11. The center electrode is attached to the center electrode 14 disposed within the center bore 12 and the circular, plate-type center electrode 11 is provided with the plurality of shaped grooves, for example, U-shaped, V-shaped or combined U-shaped-V-shaped grooves. Fuel disposed on the opposite side of the ring electrode 21 can be effectively ignited simultaneously with the ignition of fuel by the spark presented between the circular plate center electrode 11 and the ring electrode 21.

Figure 1:
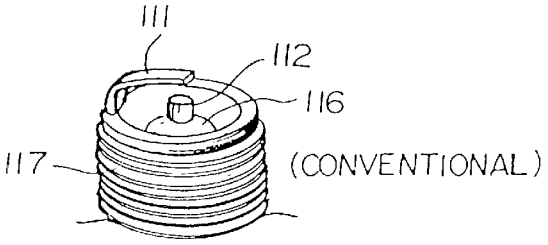
FIG. 1 is a perspective view of a conventional electrode of an ignition spark plug.

Accordingly, the ignition spark plug according to the present invention provides the forming of a spark with a substantially increased surface area, whereby the commencing of combustion is more effective than combustion ignited by conventional ignition spark plugs as shown in FIG. 1. Therefore, the combustion is completed faster than when using conventional ignition spark plugs.

Also, the ignition spark plug according to the present invention provides forming the circular plate-type center electrode 11 having a plurality of grooves 19, 19' and 19" and teeth 24, which cooperate with ring electrode 21 which extends from the threaded metal shell 17 to scatter the ignited fuel within the ignition chamber 18, so that the ignition of the fuel is effected between both of the electrodes 11 and 16.

The ignition spark plug according to the present invention achieves an excellent starting ability for an engine by increasing the size of the spark due to substantial reduction of the burning or combustion time of the fuel, while requiring no increase in the electrical power employed to create the spark since the initial combustion is very smooth in operation, the timing of respective power strokes, and the actual power effected by combustion.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. An ignition spark plug which comprises:

an insulator containing a center bore, a center electrode extending through the center bore and terminating as a circular plate which extends beyond the end of the insulator; and;

a housing surrounding at least a portion of the insulator, said housing being provided with a ring electrode disposed at the end thereof adjacent the circular plate, said circular plate having substantially equivalent circular dimensions as the ring electrode and is spaced apart from the ring electrode in opposing relationships, to define a spark gap therebetween whereby an improved ignition spark plug is created which provides excellent starting ability of the engine, complete combustion of the fuel in the ignition chamber, and prevents the exhaust gas from fuming out.

2. The ignition spark plug of claim 1, wherein the distance between insulator and the housing gradually increases toward the spark gap, thereby providing an enlarged ignition space adjacent to the spark gap.

3. The ignition spark plug of claim 1, wherein the periphery of the circular plate-type of the center electrode is provided with a plurality of grooves.

4. The ignition spark plug of claim 3, wherein the grooves have a U-shaped or V-shaped configuration or a combination thereof.

* * * * *